United States Patent [19]

Zeck

[11] Patent Number: 4,531,895

[45] Date of Patent: Jul. 30, 1985

[54] GAS SAMPLING PUMP

[75] Inventor: Ted E. Zeck, Snyder, Tex.

[73] Assignee: Y-Z Industries, Inc., Snyder, Tex.

[21] Appl. No.: 660,963

[22] Filed: Oct. 15, 1984

[51] Int. Cl.[3] ..... F04B 39/10

[52] U.S. Cl. ..... 417/401; 417/570

[58] Field of Search ..... 417/401, 559, 562, 569, 417/570

[56] References Cited

U.S. PATENT DOCUMENTS

| | | | |
|---|---|---|---|
| 2,122,020 | 6/1938 | Barks | 417/489 X |
| 3,312,178 | 4/1967 | Rotter et al. | 417/254 |
| 3,995,966 | 12/1976 | Blancha | 417/559 X |
| 4,137,017 | 1/1979 | Lonardo | 417/559 |
| 4,452,573 | 6/1984 | Samuel | 417/401 |
| 4,470,775 | 9/1984 | Lonardo | 417/569 |

FOREIGN PATENT DOCUMENTS

| | | | |
|---|---|---|---|
| 923589 | 2/1955 | Fed. Rep. of Germany | 417/570 |

*Primary Examiner*—Leonard E. Smith
*Attorney, Agent, or Firm*—Wendell Coffee

[57] ABSTRACT

A gas sampling pump utilizes a body with a cylindrical bore and a cylindrical plunger. A disc valve at the bottom has about the same diameter as the bore, and therefore, when it is seated upon "O" ring which forms a valve seat at the inlet of the bore and when the plunger is seated against the disc, the bore is substantially filled with the plunger and disc valve. The outlet valve is an annular valve. The outlet is connected to a sampling flask. Therefore, if the plunger is reciprocated, that from the top position, there will be a certain volume within the pump which is completely displaced at the bottom of the plunger stroke resulting in an extremely high volumetric efficiency. A balance ring biases the outlet valve to prohibit a free flow of gas when the sampling flask has less pressure than the gas inlet pressure.

8 Claims, 2 Drawing Figures

GAS SAMPLING PUMP

BACKGROUND OF THE INVENTION (1) Field of the Invention

This invention relates to measuring instruments and more particularly to a pump which delivers an exact preset volume of gas for each stroke.

(2) Description of the Prior Art

Present commercial practice is to take samples from gas pipelines. There are numerous reasons for this, but the most common reason is when the ownership of the gas is being transferred, it is important to know the quality of the gas within the pipeline or other container. The quantity of the gas is also measured. Sampling devices commonly include a sample flask or container. The container is attached to a pumping device which pumps a fixed volume of gas at periodic intervals. Most common, the interval is picked as a periodic time interval, e.g., every 30 minutes. Normally, a pneumatic motor is used so that if a timing device produces a pressure pulse every 30 minutes, the motor will cause the sampling device to stroke once every 30 minutes.

To prevent contamination of the sample, the tubing of the sampling device to the flask is purged after an empty flask is connected. Also, to obtain an uncontaminated sample, the flasks are evacuated as near as possible when connected to the sampling device. Therefore, the pressure within the flasks will be far less than the pressure in the pipeline when first connected. Normally, the flasks will be connected to receive samples for an extended period of time; e.g., one week. At the end of the sampling period, the flasks will have much higher pressure than the pipeline.

U.S. Pat. No. 3,945,770, to Welker, discloses a sampling device intended to obtain a fixed amount of fluid each time the device is "stroked".

Before this application was filed, applicant caused a search to be made in the United States Patent and Trademark Office. Five patents were reported on the search, none of which appear to be pertinent to the applicant, but he is listing them herewith inasmuch as he believes that an Examiner would be interested in any patents reported by an experienced patent searcher. They are: Rogers U.S. Pat. No. 1,925,751 Lundeen U.S. Pat. No. 3,048,274 Berg U.S. Pat. No. 4,252,296 Graham U.S. Pat. No. 4,407,548 Aerd U.S. Pat. No. Re. 30,115.

SUMMARY OF THE INVENTION (1) New Functions and Surprising Results

I have invented a gas sampling pump which approaches 100% volumetric efficiency. I.e., each time the pump is stroked, it will pump the same volume of sample regardless of the pressure at which the sample is being taken or the pressure of the vessel into which the sample is pumped.

(2) Objects of this Invention

An object of this invention is to take samples of gas.

Another object of this invention is to periodically take samples of gas, taking the same present volume sample each time.

Further object of this invention is a device having the ability to easily adjust the size or volume of each sample increment.

Further objects are to achieve the above with a device that is sturdy, compact, durable, lightweight, simple, safe, efficient, versatile, ecologically compatible, energy conserving, and reliable, yet inexpensive and easy to manufacture, install, operate and maintain.

The specific nature of the invention, as well as other objects, uses, and advantages thereof, will clearly appear from the following description and from the accompanying drawing, the different views of which are not scale drawings.

DESCRIPTION OF THE PREFERRED EMBODIMENTS

Figure 1:
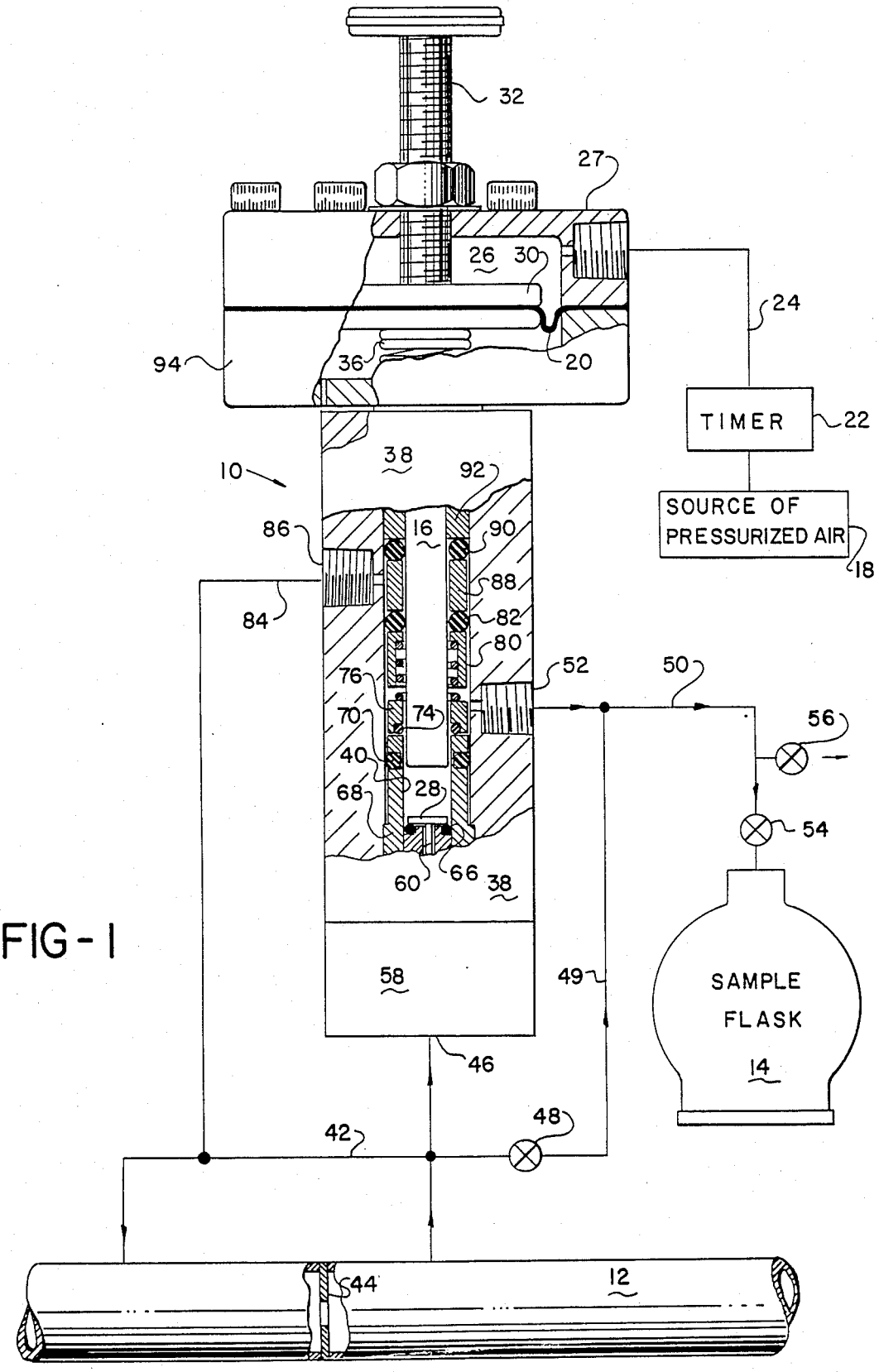
FIG. 1 is a schematical representation of a sampler with pipeline and flask according to this invention.

Referring to the drawings, there may be seen sampler pump 10. The pump 10 periodically takes samples of gas from pipeline 12 and pumps them into sample vessel 14. Plunger 16 of the pump is reciprocated by gas pressure. Preferably, the gas is supplied by air source 18. The air under pressure is periodically supplied from the source 18 to bellows or diaphragm 20. A standard gas timer 22 is adaptable for this. Gas timers are known and commercially available on the market. The timer is a pulse means for supplying gas pressure at times, which can be set, to diaphragm tube 24 which connects the timer to the diaphragm chamber 26 of the pump 10.

It will be understood by those having skill in the sampling arts, that under certain conditions, samples are desired upon a gas volume basis. I.e., the amount of gas flowing within pipeline 12 would be measured, and upon the flow of a predetermined volume of gas, a sample would be taken. However, normally, samples are taken at predetermined time intervals rather than upon flow volumes.

Regardless of when the sample is to be taken, those skilled in the art are able to provide the equipment to furnish a pulse or surge of gas to the diaphragm tube 24 to actuate the plunger 16. Also, there has been no exhaust of the gas from the diaphragm chamber 26 shown, but those with ordinary skill in the art will understand that it is normally supplied from the timer.

Sample loop 42 connects to the pipeline 12 on each side of flow restrictor 44 in the pipeline. The flow restrictor will cause a flow of fresh gas through the loop. Therefore, the loop is connected to the pump inlet 46 so that the sample being taken is a sample of the gas at that time in the pipeline. Also, purge valve 48 is connected to the loop 42. Purge line 49 is connected to the flask line 50 attached from pump outlet 52 to the sample vessel or flask 14. Therefore, it may be seen that after the sample vessel 14 is connected by flask valve 54 to the flask line 50, that the flask line 50 can be purged of air or old gas by opening purge valve 48 and waste valve 56. Some operators may prefer to also open flask valve 54 and purge the sample vessel. If the purge valve 48 is closed before the waste valve 56, the flask line 50 will be at atmospheric pressure.

Basically all that has been described above and to this point are old and well known to the gas sampling art.

Figure 2:
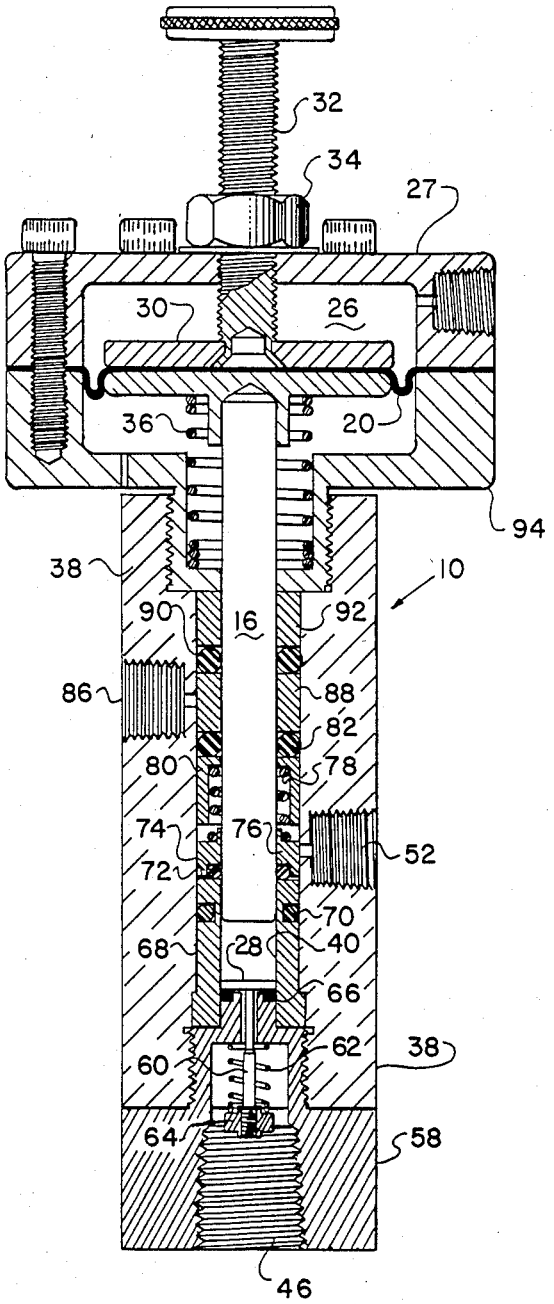
FIG. 2 is an axial sectional view of the sampler pump according to this invention.

Referring to the drawings, particularly to FIG. 2, it may be seen that the travel of the diaphragm will be the travel of the plunger 16. The plunger travels downward or on the power stroke or discharge stroke or pumping stroke until the plunger is seated upon flat inlet disc valve 28.

Upon the intake stroke, the diaphragm and plunger will travel upward until the diaphragm 20 is seated against the stop washer 30 which is immediately above the diaphragm in the diaphragm chamber 26. The position of the stop washer 30 can be adjusted by stroke adjustment screw 32 which is held securely in place in the top of the chamber by a suitable lock nut 34, as shown.

As will be pointed out later, the length of the stroke of the plunger will determine the volume displacement of the plunger on each stroke. And as will particularly pointed out, the volume, as displaced by the plunger 16 will be the volume of gas pumped upon each stroke. Therefore, by adjusting the stroke adjustment screw 32, the volume to be pumped from each stroke may be adjusted. Normally, this will be an amount less than ½ cc.

As indicated above, the power stroke or the pumping stroke is made by the compressed gas which is fed from the source of air under pressure 18 through the timer 22. The return stroke is by diaphragm spring 36 which is a helical compression spring extending from below the diaphragm 20 from the pump body 38.

Cylindrical bore 40 surrounds the plunger 16 and is coaxial with the plunger 16 and diaphragm 20 and stroke adjustment screw 32. The inlet 46 is at an end designated as the inlet end of the bore and the outlet 52 is at an area designated at the outlet end. The diaphragm 20, together with the diaphragm spring 36 and associated equipment, forms a motor means for reciprocating the plunger.

Inlet plug 58 is threaded to the bottom of the valve body 38. Inlet 46 is within the inlet plug. A small coaxial opening at the top of the inlet plug forms an opening for disc valve stem 60 to extend through. The flat circular disc inlet valve 28 it attached to the valve stem 60. The bottom of the valve stem is threaded and has a spring stop 64 attached thereto. Inlet valve spring 62 extends from a shoulder of the inlet plug 58 to the spring stop 64. Inlet valve seat 66, in the form of an "O" ring is between the top of the inlet plug 58 and the disc valve 28.

The diameter of the disc valve 28 fits snugly within the pump bore 40 as does the plunger 16. By "fits snugly" it is meant that the elements move freely within the bore, but that there is a minimum possible space compatible with the free movement of gas between the plunger and the pump bore. The spacing between the plunger 16 and the bushings, and the spacing between the bushings and the pump body 38 has been exaggerated for clarity in FIG. 1, the schematic view. The pump bore in this area is formed by the pump bushing 68 which fits within the pump body 38. It fits tightly within the pump body 38 and is sealed to the pump body by bushing "O" ring 70. It is held in place by the inlet plug 58 as shown.

The top of the pump bushing 68 forms circular outlet valve seat 72 which encircles the plunger 16 at the outlet end. The annular outlet valve 74 is in the form of an outlet "O" ring which is held in place by the outlet valve bushing 76. The outlet valve bushing has a bore which fits snugly to the plunger 16 as defined above, and also, the outlet valve bushing 76 fits snugly (as defined above) to the pump body 38. There is an "O" ring notch formed into the outlet valve bushing 76 so that the "O" ring, when seated, is pressed against both the top of the pump bushing 68 and the plunger 16 at all times, the outlet valve bushing 76. The annular valve 74 will be pushed downward by balance spring 78. The balance spring 78 is a helical compression spring.

When the plunger 16 is at the top of the stroke, as limited by stroke adjustment screw 32 during the intake stroke, the volume between the plunger and the disc valve 28 will be the volume which will be displaced on the stroke. It may be seen that when the plunger moves on the power stroke so that it is firmly seated against the disc valve 28 by the gas pressure within the diaphragm chamber 26 that all of the gas will be displaced from the measuring volume. Since the disc valve makes a snug fit with the bore, as does the plunger, there will be substantially no gas within the measuring volume. Therefore, since all of the volume at one time is filled with gas and all the gas then displaced from the measuring volume, the volumetric efficiency of the pump will approach 100%.

The outlet 52 connects through the pump body 38 so that it is fluidly connected to the bore above the outlet valve seat 72. As explained before, gas can pass between the different parts, except where the parts are sealed by "O" rings. Therefore, upon the power stroke when the pressure within the displacement chamber is greater than the inlet pressure plus the balance spring 78, the outlet valve will rise, pushing out the valve bushing 76 so that the gas flows into the area on the outlet side of the outlet valve seat 72.

Balance ring 80 encircles the plunger 16 on the outlet side of the outlet valve bushing 76. The balance spring 78 extends between the balance ring 80 and the outlet valve bushing 76 as shown. The balance "O" ring 82 forms a balance seat seal between the plunger and the body 38 above the balance ring 80. Balance conduit 84 extends from the balance opening or balance port 86 to the loop 42 (FIG. 1). Therefore, it may be seen that the balance conduit 84 is fluidly connected to the inlet 46. The balance conduit is also attached to the body and opens into the bore on the side of the balance "O" ring seal 82 opposite the balance ring 80. In use, the pressure at the balance spring 78 will be the pressure within the sample flask 14. Therefore, if the pressure within the sample vessel 14 is greater than the inlet pressure, the balance ring 80 will be in the upper position and the balance ring will have no effect on operation except that the balance spring 78 will exert slight pressure against the outlet valve bushing to properly seat the outlet "O" ring annular valve 74.

However, should the flask 14 pressure be lower than the pressure within the inlet loop 42, the balance spring 78 will be compressed and the balance ring 80 will push down upon the outlet valve bushing 76 with greater force than the inlet pressure force through the disc valve 28. The reason the force is greater is because the exposed area of the balance "O" ring 82 is greater than the exposed area of the outlet annular valve 74. Therefore, on the intake stroke, there will be no flow into the flask 14 through the outlet 52 even though the inlet pressure is greater than the outlet pressure.

Obviously, on the power stroke, the pressure of the sample is greatly increased so that the sample is discharged from the sampling volume chamber even though the balance ring is exerting a certain amount of pressure against the annular outlet valve 74.

To prevent the escape of inlet gas through the balancing conduit 84, balancing bushing 88 is opposite the balancing port 86. Seal "O" ring 90 is above the balancing bushing 88 and spacing bushing 92 is above the sealing "O" ring 90. The spacing bushing is held in place by the lower diaphragm housing 94 which is threaded into the pump body 38, all as shown. The diaphragm spring 36 extends from this lower housing.

Pump body 38 is tubular. The opening through the axis of the tubular valve body 38 does not have a uniform diameter. The bore 40 is not formed by the body 38 but is formed by the pump bushing 68, the outlet valve bushing 76, the balance ring 80, and the balance bushing 88, along with the spacing bushing 92. The displacement volume, of course, will always be with the bore within the pump bushing 68.

Thus it may be seen that I have provided a sampling pump which approaches 100% volumetric efficiency. The amount of volume pumped each stroke may be adjusted by the sample adjusting screw 32. If the flask pressure is less than the inlet pressure, the amount of volume pumped still depends upon the amount of volume displaced by the plunger 16 and is not in free flow from the inlet to the flask.

The diaphragm chamber is the volume or chamber between the diaphragm 20 and upper housing 27.

The embodiment shown and described above is only exemplary. I do not claim to have invented all the parts, elements or steps described. Various modifications can be made in the construction, material, arrangement, and operation, and still be within the scope of my invention.

The limits of the invention and the bounds of the patent protection are measured by and defined in the following claims. The restrictive description and drawing of the specific examples above do not point out what an infringement of this patent would be, but are to enable the reader to make and use the invention.

As an aid to correlating the terms of the claims to the exemplary drawing, the following catalog of elements is provided:

10 Pump
12 Pipeline
14 Sample Flask
16 Plunger
18 Air Source
20 Diaphragm
22 Timer
24 Diaphragm Tube
26 Diaphragm Chamber
27 Upper Housing
28 Disc Valve
30 Stop Washer
32 Sample Adjusting screw
34 Lock Nut
36 Diaphragm Spring
38 Pump Body
40 Bore
42 Loop
44 Flow Restrictor
46 Inlet
48 Purge Valve
49 Purge Line
50 Flask Line
52 Outlet
54 Flask Valve
56 Waste Valve
58 Inlet Plug
60 Valve Stem
62 Inlet Valve Spring
64 Spring Stop
66 "O" Ring, Inlet Valve Seat
68 Pump Bushing
70 Bushing "O" Ring
72 Outlet Valve Seat
74 Annular Valve ("O" Ring)
76 Outlet Valve Bushing
78 Balance Spring
80 Balance Ring
82 Balance "O" Ring
84 Balance Conduit
86 Balance Port
88 Balance Bushing
90 Seal "O" Ring
94 Lower Housing
92 Spacing Bushing

I claim as my invention:

1. A gas sampling pump comprising:
a. a body,
b. a cylindrical pump bore in the body having
i. an inlet at an inlet end, and
ii. an outlet at an outlet end,
c. a cylindrical plunger having a snug fit in the bore,
d. motor means for reciprocating the plunger attached thereto,
e. a circular inlet valve seat coaxial with the bore at the inlet,
f. a flat circular disc inlet valve having a snug fit in the bore on the valve seat, coaxially therewith,
g. a circular outlet valve seat encircling the plunger at the outlet,
h. an annular outlet valve encircling the plunger,
i. seal means on the annular valve for making a sliding gas tight seal to the plunger and to the valve seat,
j. the size of the elements such that the plunger and the disc valve substantially fill the bore from the inlet valve seat to the outlet valve seat.

2. The invention as defined in claim 1 having the limitations a. through j. further comprising:
k. said inlet coaxial with the bore, and
l. a valve stem on the disc valve, coaxially therewith, extending into the inlet,
m. an inlet spring between the valve seat and stem,
n. said outlet radial of said bore on the outlet side of the outlet valve seat.

3. The invention as defined in claim 1 having the limitations a. through j. wherein said motor means includes:
k. a diaphragm,
l. pulse means for supplying the diaphragm with a pulse of pressurized gas at predetermined intervals, connected thereto,
m. said diaphragm connected to said plunger, so as to force the plunger against the disc valve.

4. The invention as defined in claim 3 having the limitations a. through m. further comprising:
n. said diaphragm being spring biased in a direction which moves the plunger to receive a fresh charge of sample, and
o. an adjustment means for limiting the distance said spring moves said diaphragm.

5. The invention as defined in claim 4 having the limitations a. through o. further comprising:
p. a balance ring surrounding the plunger adjacent the annular valve on the side opposite the outlet valve seat,
q. a balance spring between the balance ring and annular valve,
r. a balance seal between the plunger and bore touching the balance ring on the side opposite the annular valve, s. a balance conduit attached to said body and opening into said bore on the side of the balance seal opposite the balance ring, and t. said balance conduit fluidly connected to said inlet.

6. The invention as defined in claim 5 having the limitations a. through t. further comprising:

u. said inlet coaxial with the bore, and v. a valve stem on the disc valve, coaxially therewith, extending into the inlet, w. an inlet spring between the valve seat and stem, x. said outlet radial of said bore on the outlet side of the outlet valve seat.

7. A gas sampling pump comprising:

a. a body, b. a cylindrical pump bore in the body having i. an inlet at an inlet end, and ii. an outlet at an outlet end, c. a cylindrical plunger in the bore, d. motor means for reciprocating the plunger attached thereto, e. a circular inlet valve seat coaxial with the bore at the inlet, f. a flat circular disc inlet valve in the bore on the valve seat, coaxially therewith, g. a circular outlet valve seat encircling the plunger at the outlet, h. an annular outlet valve encircling the plunger, i. seal means on the annular valve for making a sliding gas tight seal to the plunger and to the valve seat, j. the size of the elements such that the plunger and the disc valve substantially fill the bore from the inlet valve seat to the outlet valve seat, k. a balance ring surrounding the plunger adjacent the annular valve on the side opposite the outlet valve seat, l. a balance spring between the balance ring and annular valve, m. a balance seal between the plunger and bore touching the balance ring on the side opposite the annular valve, n. a balance conduit attached to said body and opening into said bore on the side of the balance seal opposite the balance ring, and o. said balance conduit fluidly connected to said inlet.

8. The invention as defined in claim 7 with the limitations of a. through o. further comprising:

p. said inlet coaxial with the bore, and q. a valve stem on the disc valve, coaxially therewith, extending into the inlet, r. an inlet spring between the valve seat and stem, s. said outlet radial of said bore on the outlet side of the outlet valve seat.

* * * * *